US005151057A

United States Patent [19]

Kobayashi et al.

[11] Patent Number: 5,151,057

[45] Date of Patent: Sep. 29, 1992

[54] WATER JET PROPULSION BOAT

[75] Inventors: Noboru Kobayashi; Yoshiki Futaki, both of Iwata, Japan

[73] Assignee: Yamaha Hatsudoki Kabushiki Kaisha, Iwata, Japan

[21] Appl. No.: 680,709

[22] Filed: Apr. 4, 1991

[30] Foreign Application Priority Data

Apr. 4, 1990 [JP] Japan ..... 2-90636
Apr. 26, 1990 [JP] Japan ..... 2-113555

[51] Int. Cl.[5] ..... B63H 11/00

[52] U.S. Cl. ..... 440/38; 440/40; 440/42

[58] Field of Search ..... 440/38, 39, 40, 41, 440/42, 43, 61, 63

[56] References Cited

U.S. PATENT DOCUMENTS 3,116,710 1/1964 Cass ..... 440/61
4,325,699 4/1982 Castoldi ..... 440/47

FOREIGN PATENT DOCUMENTS 386760 9/1990 European Pat. Off. ..... 440/40
2732671 2/1979 Fed. Rep. of Germany ..... 440/38

*Primary Examiner*—Jesus D. Sotelo
*Assistant Examiner*—Stephen P. Avila
*Attorney, Agent, or Firm*—Ernest A. Beutler

[57] ABSTRACT

A watercraft propelled by a jet propulsion unit that is positioned within a tunnel in the underside of the watercraft. The jet propulsion unit is supported for pivotal movement about a horizontally extending transverse pivot access and the housing of the jet propulsion unit is divided into separate components so that the water inlet portion may be rotated to an upwardly facing service position without rotation of the discharge nozzle, steering nozzle, or reverse thrust buckets associated therewith. As a result, an extremely rigid support is accomplished which nevertheless permits ease of servicing.

62 Claims, 7 Drawing Sheets

WATER JET PROPULSION BOAT

BACKGROUND OF THE INVENTION

This invention relates to a water jet propulsion boat and more particularly to an improved jet propulsion unit for a watercraft and method of mounting the jet propulsion unit.

The advantages of employing water jet propulsion units for watercraft are well known. Among these advantages, is the ability to operate the watercraft in very shallow water and at high speeds. In addition, if the jet propulsion unit is mounted in a tunnel on the underside of the hull of the watercraft it also affords a very neat and compact arrangement for the watercraft as well as a good appearance. However, when so mounted there are certain difficulties that arise.

Specifically, the propulsion unit normally has a downwardly facing water inlet portion through which water is drawn by the impeller of the jet propulsion unit for discharge through a rearwardly facing discharge nozzle. Unlike outboard motors or the outboard drive of an inboard/outboard drive, however, it is not possible, with prior art type of constructions to move the jet propulsion unit up out of the water when the watercraft is not operating. As a result, the water inlet is normally submerged at all times and hence may be subject to the formation of barnacles and other incrustation. In addition, because of its ability to operate in shallow water, frequently the jet propulsion unit water inlet can clog with seaweed or other foreign materials.

To obviate these disadvantages, it has been proposed to mount the jet propulsion unit so that it can rotate about a longitudinally extending axis so as to bring the water inlet portion up out of the water when not in use. In addition, by providing an access opening in the hull, it will be possible to clean foreign materials from the water inlet when the jet propulsion unit is rotated to its out of the water position.

Although the aforedescribed construction has numerous advantages, as aforenoted, it also has some difficulties. Normally, the jet propulsion unit and the watercraft powered by it are steered by a pivotally supported steering nozzle disposed in proximity to the jet propulsion unit discharge nozzle. This steering nozzle is remotely operated. However, when the jet propulsion unit is rotatable about a longitudinally extending axis, then the interconnection with a remote steering control can present obvious difficulties.

Furthermore, it is frequently the practice to provide a reverse thrust bucket for cooperating with the discharge of the jet propulsion units so as to permit reverse propulsion. Again, the remote operation of said reverse thrust buckets can present substantial problems if the jet propulsion unit is rotatable about a longitudinally extending axis.

It is, therefore, a principal object to this invention to provide an improved water jet propelled boat in which the water jet propulsion unit has its water inlet rotatable about a longitudinally extending axis for cleaning, servicing and to bring it out of the water without necessitating rotation of the discharge nozzle, steering nozzle and reverse thrust bucket.

It is a further object to this invention to provide an improved mounting arrangement for a water jet propulsion unit wherein only a portion of the water jet propulsion unit is rotatable for servicing.

In addition to or in lieu, of having the water jet propulsion unit rotatable about a longitudinally extending axis for the aforenoted purposes, it has also been proposed to permit pivotal movement of the water jet propulsion unit about a transversely extending axis for the same purposes. If the unit is only pivotal about the transverse axis, this minimizes some of the aforenoted difficulties in connection with controlling the steering and reverse thrust bucket. However, another problem arises in connection with such constructions.

Previous water jet propulsion units that are pivotal about transverse axes, have employed a pair of arcuate arms on opposite sides of the jet propulsion unit that are slotted and receive pins carried by the jet propulsion unit so as to control its pivotal movement. The arms also serve the purpose of taking the transverse thrust. It is important that the transverse thrust be adequately absorbed due to the fact that the jet propulsion unit is steered in the aforenoted described manner. However, when pin and slot arrangements are employed, clearance is a necessity and this can give rise to problems.

It is, therefore, a still further object to this invention to provide an improved arrangement for pivotally supporting a jet propulsion unit for movement about a transverse axis while absorbing all side thrusts without the necessity of incorporating clearances.

SUMMARY OF THE INVENTION

A first feature of this invention is adapted to be embodied in a water jet propelled boat comprised of a hull and a jet propulsion unit. The jet propulsion unit has an outer housing defining a water inlet portion having a downwardly facing water inlet opening through which water may be drawn from the body of water in which the watercraft is operating, an impeller portion for receiving an impeller that draws the water through the water inlet portion, and a discharge nozzle portion for discharging the water moved by the impeller for propelling the watercraft. At least the water inlet portion is rotatable relative to another portion of the outer housing about an axis for raising the water inlet opening from its downwardly facing position to an out of the water position when the boat remains in the body of water. Means are provided for supporting the discharge nozzle portion relative to the hull against rotation when the water inlet portion is rotatable between its positions.

Another feature of the invention is adapted to be embodied in a water jet propelled boat comprised of a hull having a pair of spaced apart support arms that are pivotally carried by the hull. A jet propulsion unit is incorporated having a housing assembly comprised of a water inlet portion, an impeller portion containing an impeller for drawing water through the water inlet portion from a body of water in which the boat is operating, and a discharge nozzle for discharging water from the impeller portion for propelling the boat. Means connect the support arms to the jet propulsion unit housing assembly for pivotal movement of the jet propulsion unit relative to the hull upon pivotally movement of the support arms.

DETAILED DESCRIPTION OF THE PREFERRED EMBODIMENT OF THE INVENTION

Figure 1:
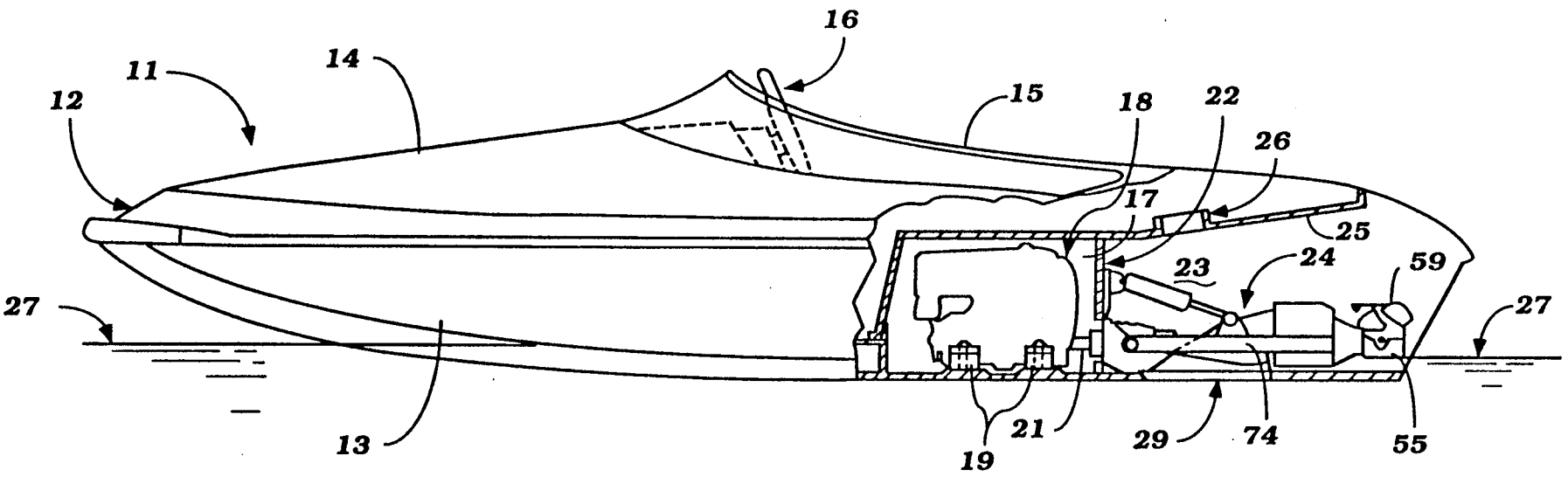
FIG. 1 is a side elevational view of a watercraft powered by a jet propulsion unit constructed in accordance with an embodiment of the invention, with a portion broken away so as to more clearly show certain details of the construction.

Referring first in detail to FIG. 1, a watercraft having a jet propulsion unit constructed and mounted in accordance with an embodiment of the invention is identified generally by the reference numeral 11. The watercraft 11 has a hull, indicated generally by the reference numeral 12 which may have any suitable configuration and which may be comprised of a lower hull portion 13 and a deck portion 14 with these portions being formed from suitable material such as a molded fiberglass reinforced resin. In the illustrated embodiment, the hull 12 is provided with a rearwardly positioned passenger compartment 15 in which a steering wheel 16 and other controls are provided for operating the watercraft 11.

The central rear portion of the lower part of the hull 13 is formed with an engine compartment 17 in which an internal combustion 18 of any known type is mounted on engine supports 19. The engine 18 has its output shaft 21 extending rearwardly through a bulkhead 22 formed forwardly of a tunnel 23 that extends generally along the longitudinal axis of the watercraft and in which a jet propulsion unit, indicated generally be reference numeral 24 is positioned. The tunnel 23 is defined in part by a horizontally extending surface 25 of the hull 12 in which an access opening 26 is provided for a purpose to be described. The watercraft 11 is designed to be operated in a body of water at a normal water level as shown by the line 27 in the certain of the figures.

Figure 2:
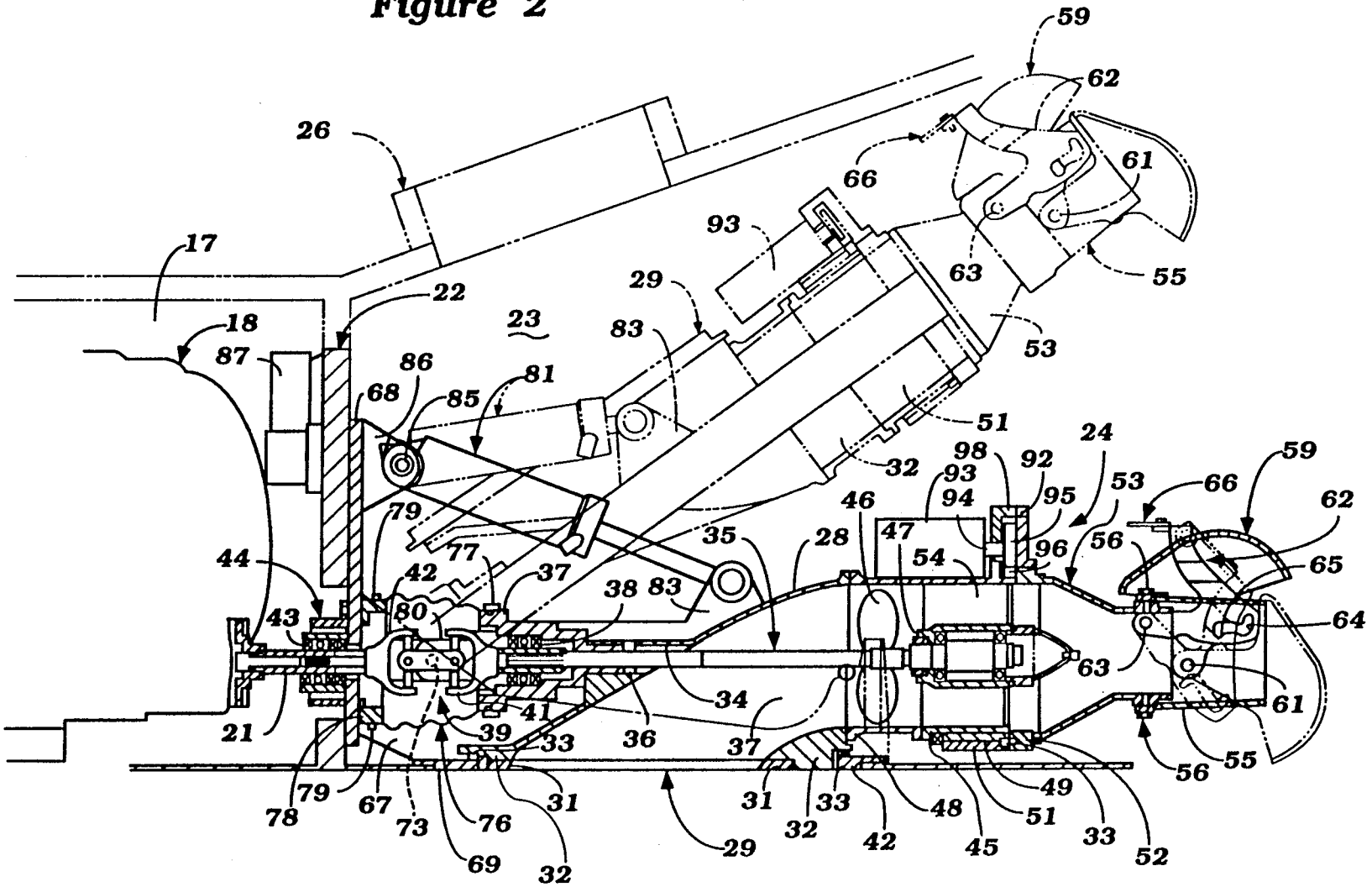
FIG. 2 is an enlarged cross sectional view showing the propulsion unit in its normal position in solid lines and in its out of the water servicing position in phantom lines.
Figure 5:
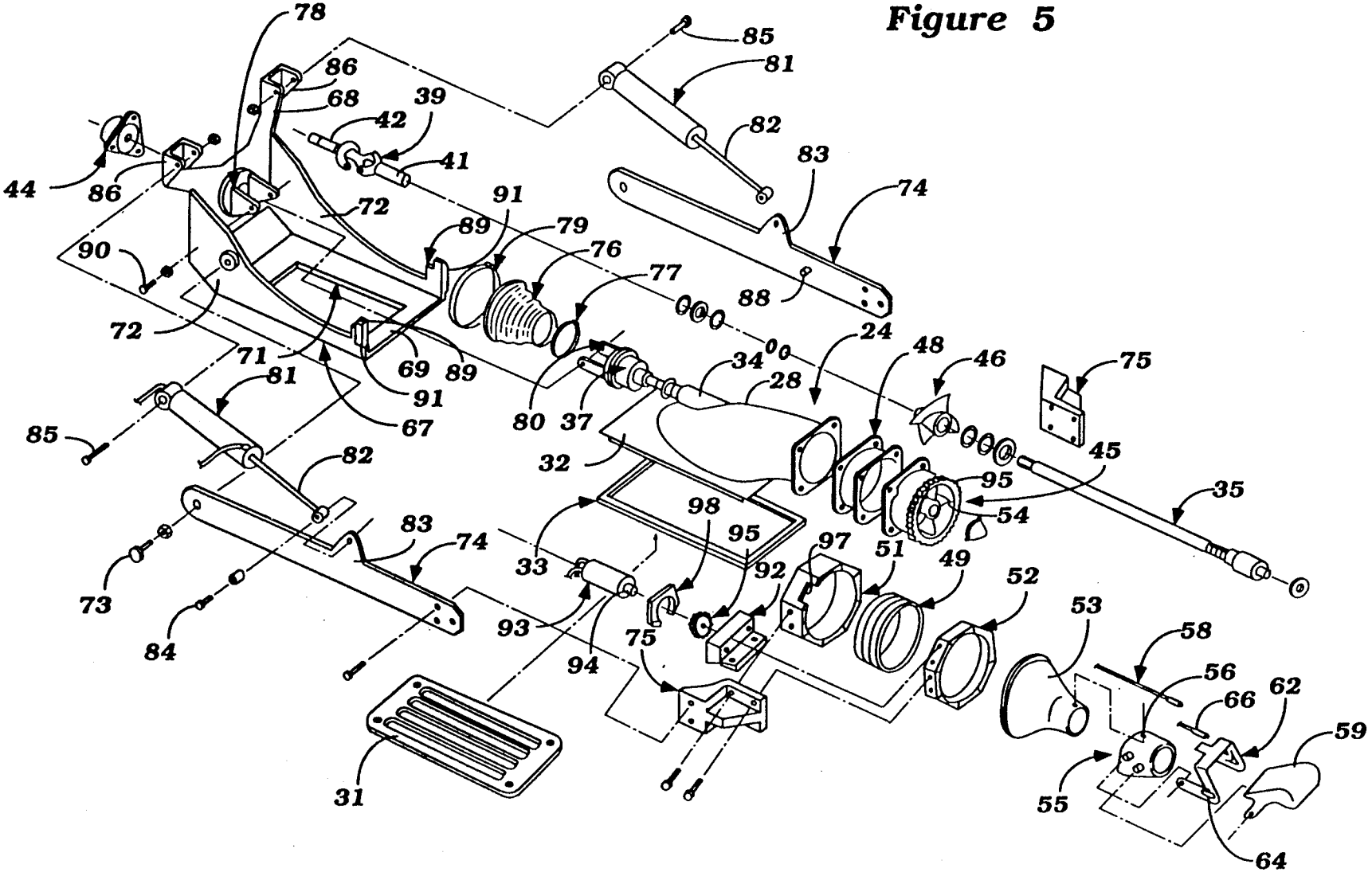
FIG. 5 is an exploded perspective view showing the jet propulsion unit and its mounting arrangement within the watercraft.

Referring now to the remaining figures and initially primarily to FIGS. 2 and 5, the jet propulsion unit 24 includes an outer housing that is comprised of an inlet portion 28 that defines a downwardly facing water inlet opening 29. The inlet opening 29 is defined by a grill like member 31 that is affixed to a housing flange 32 of the housing portion 28 and which also faces downwardly. The flange 32 has generally rectangular configuration and carries a downwardly facing seal 33, for a purpose to be described.

The water inlet portion 28 has a forwardly extending pilot portion 34 that passes an impeller shaft 35. A seal 36 surrounds the impeller shaft 35 within the portion 34 and provides a water seal to preclude water leakage.

The forward end of the housing portion 34 receives a fitting 37 that carries a seal and bearing 38 for journaling the impeller shaft 35 adjacent the forward end thereof. A universal joint, indicated generally by the reference numeral 39 has a yoke portion 41 that has a splined connection to the impeller shaft 35. The yoke portion 41 is, in turn, connected to a further yoke portion 42 that has a splined connection 43 to the engine output shaft 21. This splined connection is contained within a bushing 44 which is mounted in a manner to be described. The aforedescribed connection permits a driving connection between the engine output shaft 21 and the impeller shaft 35 which also permits the jet propulsion unit 24 to be pivoted about a transverse, horizontal axis as defined by the universal joint 39 and a further construction, to be described.

Rearwardly of the inlet portion 28 of the jet propulsion unit outer housing, there is provided an impeller housing, indicated generally by the reference numeral 45 in which an impeller 46 is contained. The impeller 46 is suitably coupled to the impeller shaft 35. The rear end of the impeller shaft 35 is journaled within a bearing assembly 47 that is carried in the impeller housing 45 of the jet propulsion unit housing in a suitable manner. A flange assembly, indicated generally by the reference numeral 48 is provided at the forward portion of the impeller housing 45 for attaching the impeller housing 45 to a corresponding flange of the water inlet portion 28.

The impeller housing 45 is formed with a cylindrical surface that is journaled by means of a bushing 49 within a bearing member 51. The bearing member 51 is, in turn, affixed by means of a coupling plate 52 to a discharge nozzle 53 which also forms a component of the outer housing assembly of the jet propulsion unit 24. The discharge nozzle 53 receives water which has been discharged from the impeller section 45 by the impeller 46 past straightening vanes 54 formed integrally with the impeller housing 45.

Figure 7:
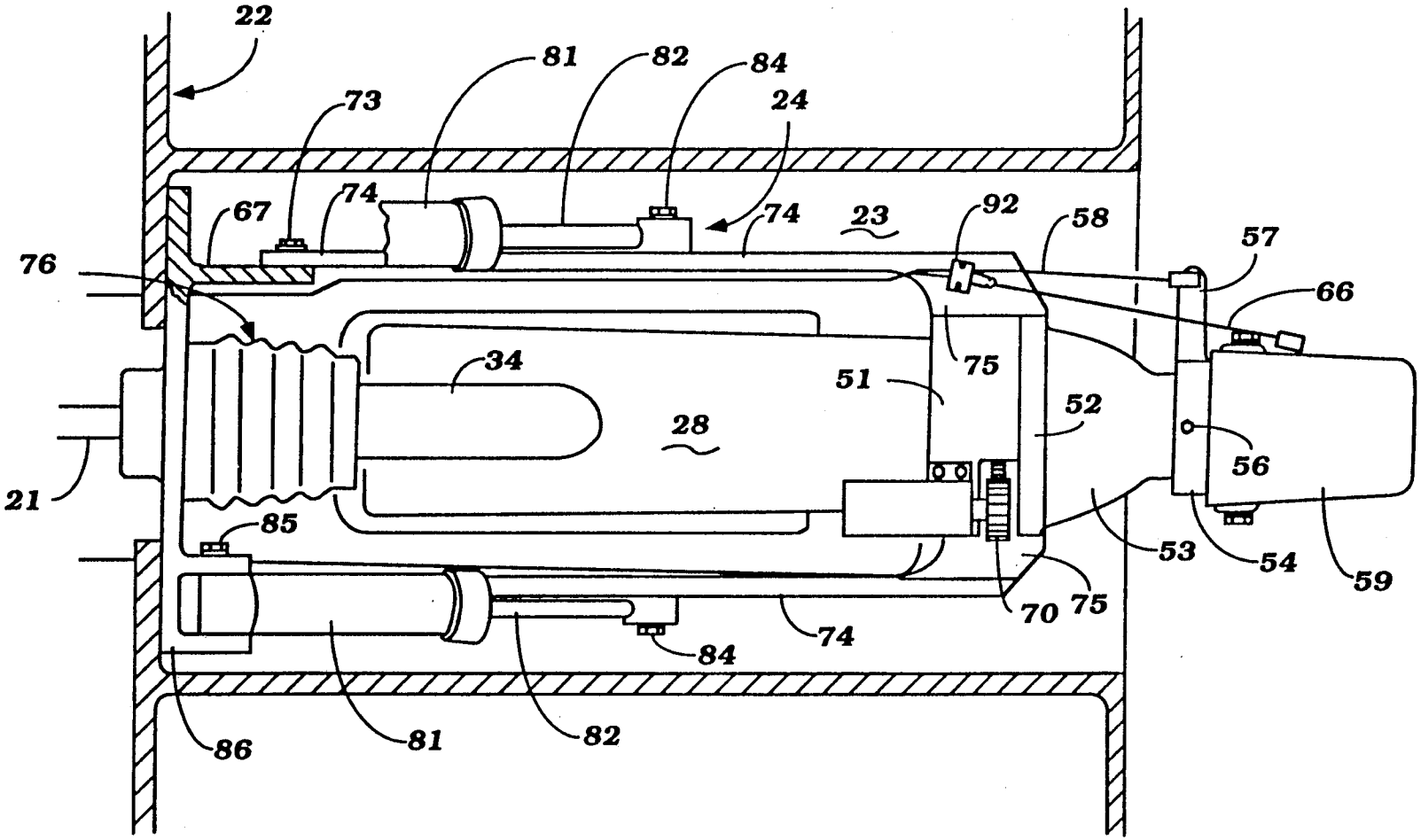
FIG. 7 is a top plan view the jet propulsion unit showing the watercraft in cross section.

A steering nozzle, indicated generally by the reference numeral 55 is supported for steering movement at the discharge end of the discharge nozzle 53 by means of vertically extending pivot pins 56. The steering nozzle 55 has an outwardly extending steering arm 57 (FIG. 7) formed integrally with it to which a bowden wire 58 is affixed by a suitable coupling. The forward end of the bowden wire 5 is connected to the steering wheel 16 in appropriate manner for steering of the watercraft in a manner as is well known with such jet propulsion units.

A reverse thrust bucket 59 has arm portions that are journaled on opposite sides of the steering nozzle 55 by means of pivot pins 61 for movement between a normal forward drive position as shown in solid lines in FIG. 2 and in a reverse thrust position as shown by ..-lines in this same figure. An actuating lever 62 is also pivoted on the reverse thrust bucket 59 by means of pivot pins 63 and has a cam slot 64 that receives pins 65 of the reverse thrust bucket 59. An operating bowden wire 66 is connected to the actuating lever 62 and is operative when pulled to pivot the actuating lever 62 and move the reverse thrust bucket 59 between its forward and reverse positions. The forward end of the bowden wire 66 is connected to an appropriate control positioned in the passenger compartment 15 which control does not appear in the figures.

The construction by which the jet propulsion unit 24 is mounted within the tunnel 23 will now be described by particular reference to FIGS. 2 through 5. This mounting arrangement includes a cradle assembly, indicated generally by the reference numeral 67 which is affixed in a suitable manner to the rear side of the bulkhead 22 and to which bushing 44 is affixed. The cradle assembly 67, has a generally vertically extending wall 68 that is positioned in confronting relationship to the rear side of the bulkhead 22 and a horizontally extending portion 69 in which an opening 71 is formed which opening registered with the inlet opening 29 of the jet propulsion unit housing portion 28. The seal 33 as afore described is normally in sealingly engagement with the horizontally extending portion 69 around the opening 71 so as to provide against water and air leakage in this area while permitting unrestricted flow to the water inlet opening 29.

The cradle assembly 67 also has a pair of vertically extending side walls 72 that are integrally connected with the front wall 68 and the bottom wall 69 so as to offer reinforcing. In addition, the side walls 72 receive pivot bolts 73 that are aligned with the universal joint 39, for a reason to be described, and which pivotally journal a pair of spaced apart support arms 74 at their forward ends. The support arms 74 are, in turn, affixed at their rear ends to mounting brackets 75 which brackets are affixed by threaded fasteners to the support arm 74 and to the bearing member 51. As a result of this construction, the jet propulsion unit 24 will be pivotally supported by the cradle assembly 67 about the pivot axis defined by the pivot bolts 73.

This pivotally movement is accommodated by the universal joint 39 as afore described. The universal joint 39 is encircled and sealed by means of a flexible boot 76 that is secured to the fitting 37 by means of a clamp 77 and secured to an extending portion 78 of the mounting cradle assembly 67 by means of a clamp 79 so as to provide good water tight sealing for the universal joint 39 while permitting its free rotation and free pivotal movement.

The fitting 37 has a pair of forwardly extending arms 80 that are pivotally connected to a pair of extending arms of the portion 78 of the cradle 72 by means of pivot bolts 90 so as to further provide pivotally support for the jet propulsion unit 24 relative to the cradle assembly 67.

Figure 3:
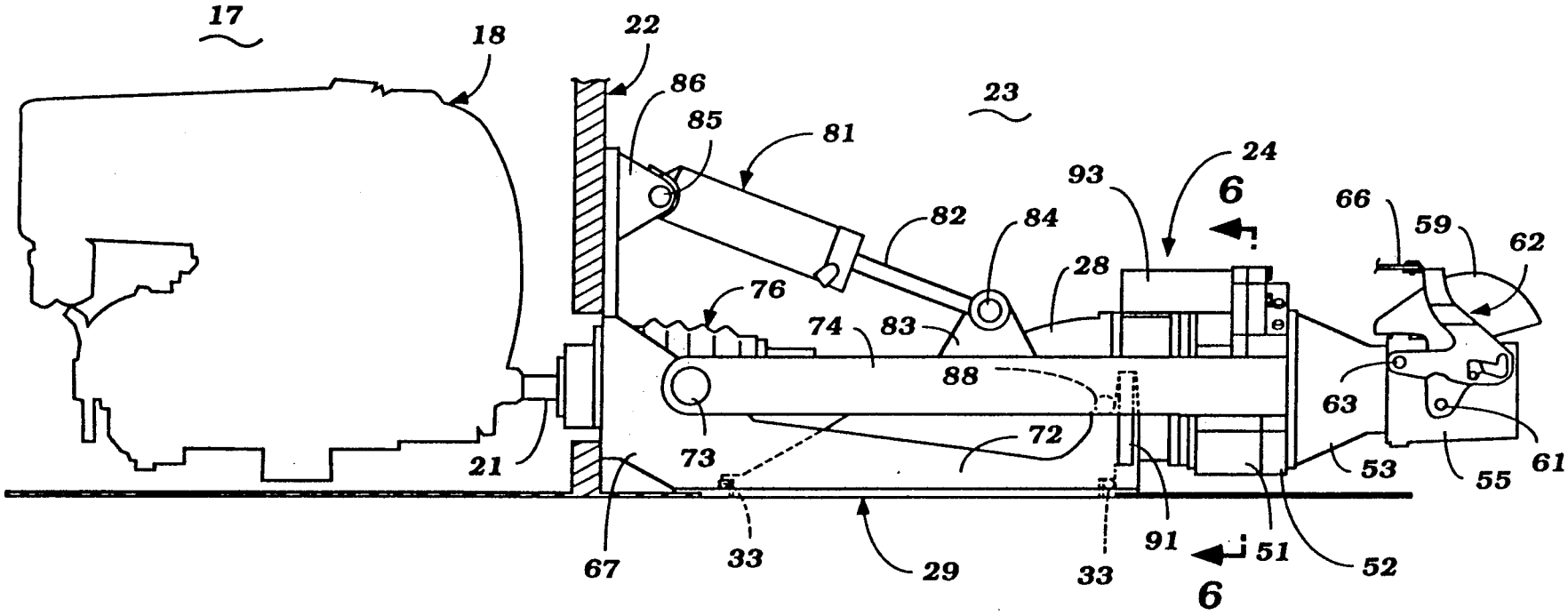
FIG. 3 is a side elevational view, in part similar to FIG. 1, showing the jet propulsion unit and its powering engine with a portion in cross section and in the normal operating condition of the jet propulsion unit.
Figure 4:
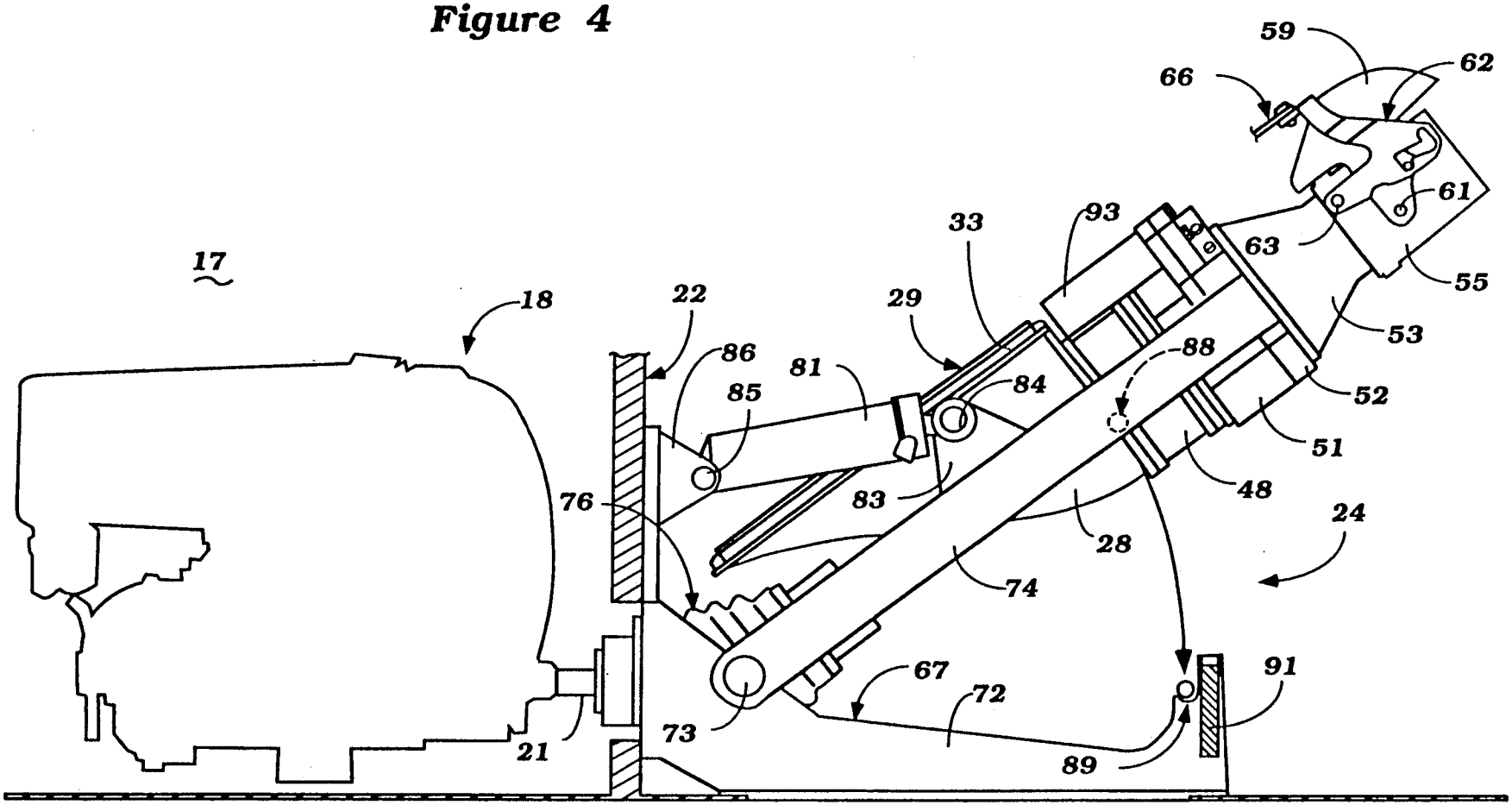
FIG. 4 is a view in part similar to FIG. 3 but shows the jet propulsion unit in its out of the water position.

The pivotal movement of the jet propulsion unit 24 about the horizontally disposed transverse axis defined by the pivot bolts 73 and 90 permits movement of the jet propulsion unit 24 from its normal operative position as shown in FIG. 3 to an elevated position as shown in FIG. 4 and the phantom line view of FIG. 2. This permits the water inlet 29 to be raised out of the body of water in which the watercraft is operating above the normal water level 27 so as to preclude the likelihood of incrustation occurring on the water inlet portion 29.

A power operated device is incorporated so as to pivot the jet propulsion unit 24 about the afore described horizontally extending transverse axis. This power device includes a pair of hydraulically operated cylinders 81 that have piston rods 82 connected to an extending portion 83 of the supporting arms 74 by means of pivot bolts 84. The cylinders of the units 81 are pivotally connected, by means of pivot bolts 85 to mounting portions 86 formed integrally with the cradle assembly 67 at the upper end of its vertically extending portion 68 on opposite sides thereof. In order to supply fluid under pressure to actuate the fluid cylinders 81, there is provided an electrically driven reversible pump and valve assembly, indicated generally by the reference numeral 87, that is mounted on the forward side of the bulk head 22 and which is controlled by a suitable remotely positioned controller (not shown).

It should be readily apparent that there are substantial side thrusts generated on the jet propulsion unit 24 when in its operating position and particularly when the steering nozzle 55 is pivoted. The support arms 74 and their rigid connection to the bearing member 51 through the mounting bracket 75 insures a rigid assembly that will take these side thrusts. In addition, the support arms 74 have inwardly extending pin portions 88 which are received in complementary recesses 89 formed in upstanding portions 91 of the cradle assembly 67 when the jet propulsion unit 24 is in its normal operative position so as to insure a rigid assembly with minimum likelihood of movement under these forces. In addition and unlike prior art constructions, no pin and slot arrangement is required for controlling the pivotally movement of the jet propulsion unit 24 and, accordingly, an extremely rigid, noise free and strong construction will result.

It should be readily apparent that the pivotal movement of the jet propulsion unit 24 between its normal operative position and its raised out of the water position can be accommodated by flexure of the wire actuators 58 and 66. Their protective sheaths are affixed by means of a fastener or retainer 92 to the mounting bracket 75 at one side of the jet propulsion unit 24 (FIG. 7) so as to insure against kinking of the transmitters.

Figure 6:
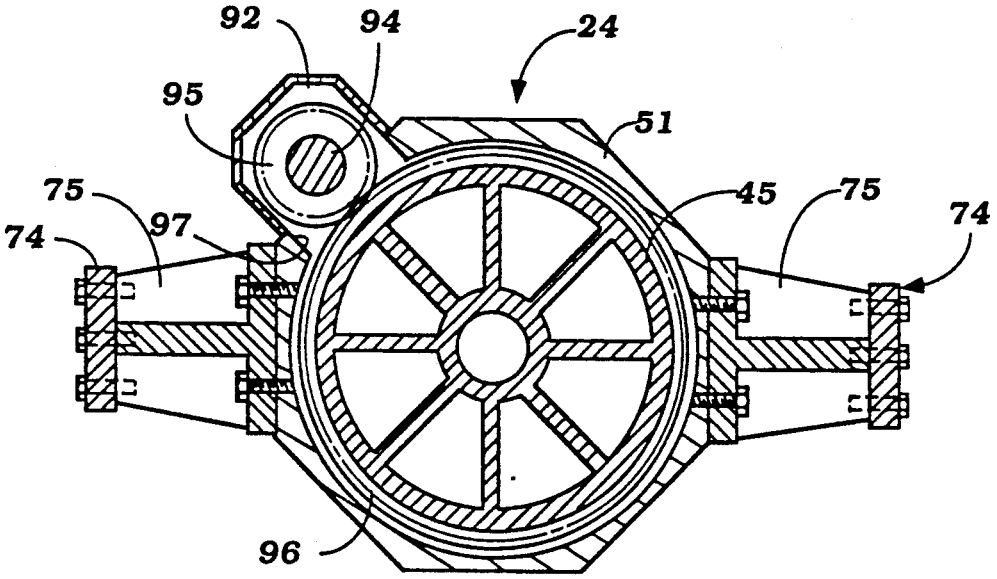
FIG. 6 is a cross sectional view taken along the line 6—6 of FIG. 3.

In addition to the pivotal movement about the transversely extending horizontal axis, the jet propulsion unit 24 is constructed so that the water inlet portion 28 may be rotated between a downwardly facing position as shown in FIGS. 1, the solid line view of FIG. 2 and FIG. 3, and an upwardly facing position as shown in the phantom line view of FIG. 2 and in FIG. 4. This brings the water inlet opening 29 in registry with the access opening 26 so that any entrapped foreign material may easily be removed without necessitating removal of the watercraft 11 from the body of water in which the watercraft is operating. Unlike prior constructions, it is not necessary to rotate the entire jet propulsion unit 24 but only the water inlet portion 28 thereof. The structure for accomplishing this result is best shown in FIG. 6 in addition to FIGS. 2 through 5.

It has been previously noted that the impeller housing 45 is mounted within the bearing member 51 for rotation by the bushing 49 and that the impeller housing 45 is affixed to the water inlet portion 28. The bearing member 51 also has mounted to it, by means of a supporting bracket 92, an electric drive motor 93. The electric drive motor 93 has a driven shaft 94 to which is affixed a drive gear 95. The drive gear 95 is enmeshed with a driven ring gear 96 which is formed integrally with the impeller housing 45. This drive gear 95 extends through a notch 97 formed in the bearing member 51 and is enclosed by means of a cover plate 98 so as to provide a driving arrangement between the drive gear 95 and the driven ring gear 96. When the motor 93 is energized, the ring gear 96 will be rotated along with the impeller housing 45 and water inlet portion 28 from a downwardly facing position, as aforenoted, to the upwardly facing service position. When in this position as shown in FIGS. 2 and 4, servicing can be possible by permitting clearing of foreign material from the water inlet 29 and specifically from the screen 31. However, since the discharge nozzle 53 and steering nozzle 55 do not rotate, there is no problem with damaging the wire transmitters 58 or 66 or for accommodating such rotary motion at was necessary with the prior art constructions.

From the foregoing description it should be readily apparent that the described jet propulsion unit is constructed and supported in such a way as to permit it to be easily pivoted up out of the water and rotated for servicing and cleaning of the water inlet without interfering with the construction for steering the discharge nozzle or for effecting operation of the reverse thrust bucket. Of course, the foregoing description is that of a preferred embodiment of the invention and various changes and modifications may be made without departing from the spirit and scope of the invention, as defined by the appended claims.

We claim:

1. A water jet propelled boat comprised of a hull, a jet propulsion unit having an outer housing comprised of a water inlet portion having a water inlet opening, an impeller portion containing an impeller for drawing water through said water inlet portion from a body of water in which said boat is operating and a discharge nozzle portion for discharging water from said water inlet portion for propelling said boat, at least said water inlet portion being rotatable relative to another of said portions about an axis for raising said water inlet opening from a downwardly facing position to an elevated position when the boat remains in the body of water, and means for supporting said discharge nozzle portion against rotation relative to said hull when said water inlet portion is rotated between its positions.

2. A water jet propelled boat as set forth in claim 1 wherein the hull has a tunnel in which the jet propulsion unit is contained.

3. A water jet propelled boat as set forth in claim 2 wherein the hull has an access opening formed in the tunnel through which the water inlet portion may be accessed when rotated to its out of the water position.

4. A water jet propelled boat as set forth in claim 1 further including means for supporting said jet propulsion unit for movement as a unit relative to the hull in a direction other than about its rotational axis.

5. A water jet propelled boat as set forth in claim 4 wherein the movement in the other direction is effective to raise and lower the inlet opening relative to the body of water in which the boat is.

6. A water jet propelled boat as set forth in claim 5 wherein the other movement is pivotal movement about an axis that extend transversely and horizontally relative to the hull.

7. A water jet propelled boat as set forth in claim 6 further including a power source supported within the hull for driving the impeller.

8. A water jet propelled boat as set forth in claim 7 wherein the power source comprises an internal combustion engine having an output shaft connected by means of a universal joint to the impeller.

9. A water jet propelled boat as set forth in claim 8 wherein the universal joint lies on the transverse horizontal axis.

10. A water jet propelled boat as set forth in claim 6 wherein the hull has a tunnel in which the jet propulsion unit is contained.

11. A water jet propelled boat as set forth in claim 10 wherein the hull has an access opening formed in the tunnel through which the water inlet portion may be accessed when rotated to its out of the water position.

12. A water jet propelled boat as set forth in claim 11 further including a pivotally supported steering nozzle connected to the discharge nozzle portion and operated from a remotely located position.

13. A water jet propelled boat as set forth in claim 12 further including a reverse thrust bucket pivotally supported on said discharge nozzle portion and operated from a remotely located position.

14. A water jet propelled boat as set forth in claim 13 wherein there is further provided a steering nozzle pivotally supported on the discharge nozzle portion and the reverse thrust bucket is pivotally supported on the steering nozzle.

15. A water jet propelled boat comprised of a hull, a pair of spaced apart support arms pivotally carried by said hull about a pivot axis, a jet propulsion unit having a housing assembly comprised of a water inlet portion, an impeller portion containing an impeller for drawing water through said water inlet portion from a body of water in which said boat is operating and a discharge nozzle for discharging water from said impeller portion for propelling said boat, and means connecting said support arms to said jet propulsion unit housing assembly for pivotal movement of said jet propulsion unit relative to said hull upon pivotal movement of said support arms.

16. A water jet propelled boat as set forth in claim 15 further including a power source supported within the hull for driving the impeller.

17. A water jet propelled boat as set forth in claim 16 wherein the power source comprises an internal combustion engine having an output shaft connected by means of a universal joint to the impeller.

18. A water jet propelled boat as set forth in claim 17 wherein the universal joint lies on the pivot axis.

19. A water jet propelled boat as set forth in claim 18 wherein the pivot axis extends transversely to the longitudinal axis of the boat and is substantially horizontally disposed.

20. A water jet propelled boat as set forth in claim 15 wherein the hull has a tunnel in which the jet propulsion unit is contained.

21. A water jet propelled boat as set forth in claim 20 further including a power source supported within the hull for driving the impeller.

22. A water jet propelled boat as set forth in claim 21 wherein the power source comprises an internal combustion engine having an output shaft connected by means of a universal joint to the impeller.

23. A water jet propelled boat as set forth in claim 22 wherein the universal joint lies on the pivot axis.

24. A water jet propelled boat as set forth in claim 23 wherein the pivot axis extends transversely to the longitudinal axis of the boat and is substantially horizontally disposed.

25. A water jet propelled boat as set forth in claim 15 wherein the arms are affixed to a portion of the jet propulsion unit housing.

26. A water jet propelled boat as set forth in claim 25 wherein the water inlet portion of the jet propulsion unit is rotatable about an axis coincident with the axis of the impeller relative to the portion of the housing to which the arms are affixed.

27. A water jet propelled boat as set forth in claim 26 wherein the arms are affixed to the housing in proximity to the discharge nozzle.

28. A water jet propelled boat as set forth in claim 27 further including a pivotally supported steering nozzle carried by the discharge nozzle for steering of the boat.

29. A water jet propelled boat as set forth in claim 28 wherein the hull has a tunnel in which the jet propulsion unit is contained.

30. A water jet propelled boat as set forth in claim 29 further including a power source supported within the hull for driving the impeller.

31. A water jet propelled boat as set forth in claim 30 wherein the power source comprises an internal combustion engine having an output shaft connected by means of a universal joint to the impeller.

32. A water jet propelled boat as set forth in claim 31 wherein the universal joint lies on the pivot axis.

33. A water jet propelled boat as set forth in claim 32 wherein the pivot axis extends transversely to the longitudinal axis of the boat and is substantially horizontally disposed.

34. A water jet propelled boat as set forth in claim 1 further including a support cradle to which the jet propulsion unit is mounted and which is attachable as a unit with the jet propulsion unit to the hull.

35. A water jet propelled boat as set forth in claim 34 wherein the support cradle has a lower portion that is adapted to underlie the water inlet opening of the jet propulsion unit when the water inlet opening is in its downwardly facing position and having an opening therein for permitting water to communicate with said water inlet opening from the body of water in which the boat is operating.

36. A water jet propelled boat as set forth in claim 35 further including seal means for providing a seal between the opening in the cradle and the water inlet opening when the water inlet opening is in its downwardly facing position.

37. A water jet propelled boat as set forth in claim 2 further including a support cradle to which the jet propulsion unit is mounted and which is attachable as a unit with the jet propulsion unit to the hull.

38. A water jet propelled boat as set forth in claim 37 wherein the support cradle has a lower portion that is adapted to underlie the water inlet opening of the jet propulsion unit when the water inlet opening is in its downwardly facing position and having an opening herein for permitting water to communicate with said water inlet opening from the body of water in which the boat is operating.

39. A water jet propelled boat as set forth in claim 38 further including seal means for providing a seal between the opening in the cradle and the water inlet opening when the water inlet opening is in its downwardly facing position.

40. A water jet propelled boat as set forth in claim 6 further including a support cradle to which the jet propulsion unit is mounted and which is attachable as a unit with the jet propulsion unit to the hull.

41. A water jet propelled boat as set forth in claim 40 wherein the support cradle has a lower portion that is adapted to underlie the water inlet opening of the jet propulsion unit when the water inlet opening is in its downwardly facing position and having an opening therein for permitting water to communicate with said water inlet opening from the body of water in which the boat is operating.

42. A water jet propelled boat as set forth in claim 41 further including seal means for providing a seal between the opening in the cradle and the water inlet opening when the water inlet opening is in its downwardly facing position.

43. A water jet propelled boat as set forth in claim 6 further including power means carried by the support cradle for effecting the pivotal movement of the jet propulsion unit and the rotating movement of the water inlet portion.

44. A water jet propelled boat as set forth in claim 43 wherein the supporting cradle has an upstanding wall member adapted to be affixed to a bulk head of the hull which defines the forward extremity of the tunnel.

45. A water jet propelled boat as set forth in claim 44 wherein the power means includes a hydraulic motor interconnected between the upstanding wall member and the jet propulsion unit for effecting movement of the jet propulsion unit.

46. A water jet propelled boat as set forth in claim 15 further including a support cradle, the pair of spaced apart support arms being pivotally connected to said support cradle for mounting the jet propulsion unit on the support cradle and means for affixing said support cradle to the hull.

47. A water jet propelled boat as set forth in claim 46 wherein the support cradle has a lower portion that is adapted to underlie the water inlet opening of the jet propulsion unit when the water inlet opening is in its downwardly facing position and having an opening therein for permitting water to communicate with said water inlet opening from the body of water in which the boat is operating.

48. A water jet propelled boat as set forth in claim 47 further including seal means for providing a seal between the opening in the cradle and the water inlet opening when the water inlet opening is in its downwardly facing position.

49. A water jet propelled boat as set forth in claim 46 further including power means carried by the support cradle for effecting the pivotal movement of the jet propulsion unit and the rotating movement of the water inlet portion.

50. A water jet propelled boat as set forth in claim 49 wherein the supporting cradle has an upstanding wall member adapted to be affixed to a bulk head of the hull which defines the forward extremity of the tunnel.

51. A water jet propelled boat as set forth in claim 50 wherein the power means includes a hydraulic motor interconnected between the upstanding wall member and the jet propulsion unit for effecting movement of the jet propulsion unit.

52. A water jet propelled boat as set forth in claim 46 wherein the hull has a tunnel in which the jet propulsion unit is contained.

53. A water jet propelled boat as set forth in claim 52 wherein the support cradle has a lower portion that is adapted to underlie the water inlet opening of the jet propulsion unit when the water inlet opening is in its downwardly facing position and having an opening therein for permitting water to communicate with said water inlet opening from the body of water in which the boat is operating.

54. A water jet propelled boat as set forth in claim 53 further including seal means for providing a seal between the opening in the cradle and the water inlet opening when the water inlet opening is in its downwardly facing position.

55. A water jet propelled boat as set forth in claim 52 further including power means carried by the support cradle for effecting the pivotal movement of the jet propulsion unit and the rotating movement of the water inlet portion.

56. A water jet propelled boat as set forth in claim 55 wherein the supporting cradle had an upstanding wall member adapted to be affixed to a bulk head of the hull which defines the forward extremity of the tunnel.

57. A water jet propelled boat as set forth in claim 56 wherein the power means includes a hydraulic motor interconnected between the upstanding wall member and the jet propulsion unit for effective movement of the jet propulsion unit.

58. A water jet propelled boat comprised of a hull, a unitary assembly comprised of a supporting cradle, a jet propulsion unit having a water inlet portion through which water may be drawn from a body of water in which said boat is operating, an impeller portion containing an impeller for drawing water through said water inlet portion, and a discharge nozzle for discharging the water pumped by said impeller for propelling said boat, and means for mounting said jet propulsion unit on said cradle for movement of at least said water inlet portion relative thereto, and means for mounting said unitary assembly to said hull.

59. A water jet propelled boat as set forth in claim 58 wherein the hull defines a tunnel at the rear end thereof and wherein the unitary assembly is mounted at least in part within the tunnel.

60. A water jet propelled boat as set forth in claim 59 wherein the supporting cradle has an upstanding wall member adapted to be affixed to a bulk head of the hull which defines the forward extremity of the tunnel.

61. A water jet propelled boat as set forth in claim 60 wherein the support cradle has a lower portion that is adapted to underlie the water inlet opening of the jet propulsion unit when the water inlet opening is in its downwardly facing position and having an opening therein for permitting water to communicate with said water inlet opening from the body of water in which the boat is operating.

62. A water jet propelled boat as set forth in claim 61 further including seal means for providing a seal between the opening in the cradle and the water inlet opening when the water inlet opening is in its downwardly facing position.

* * * * *

UNITED STATES PATENT AND TRADEMARK OFFICE

CERTIFICATE OF CORRECTION

PATENT NO. : 5,151,057

DATED : September 29, 1992

INVENTOR(S) : Kobayashi, et al

It is certified that error appears in the above-identified patent and that said Letters Patent is hereby corrected as shown below:

On the Title Page under "U.S. Patent Documents" insert the following:

--3,207,116 9/1965 France--.

Column 9, line 40, Claim 38, "herein" should be --therein--.

Column 11, line 6, Claim 57, "effective" should be --effecting--.

Signed and Sealed this

Twenty-sixth Day of October, 1993

*Attest:*

Bruce Lehman

BRUCE LEHMAN

*Attesting Officer*

*Commissioner of Patents and Trademarks*